US009885243B2

(12) United States Patent
Chouhan et al.

(10) Patent No.: US 9,885,243 B2
(45) Date of Patent: Feb. 6, 2018

(54) TURBINE BUCKET HAVING OUTLET PATH IN SHROUD

(71) Applicant: General Electric Company, Schenectady, NY (US)

(72) Inventors: Rohit Chouhan, Karnataka (IN); Shashwat Swami Jaiswal, Karnataka (IN); Zachary James Taylor, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 231 days.

(21) Appl. No.: 14/923,685

(22) Filed: Oct. 27, 2015

(65) Prior Publication Data

US 2017/0114645 A1 Apr. 27, 2017

(51) Int. Cl.
*F01D 5/18* (2006.01)
*F01D 5/02* (2006.01)
(Continued)

(52) U.S. Cl.
CPC ..... *F01D 5/18* (2013.01); *F01D 5/02* (2013.01); *F01D 5/187* (2013.01); *F01D 5/225* (2013.01);
(Continued)

(58) Field of Classification Search
CPC . F01D 5/18; F01D 5/182; F01D 5/186; F01D 5/187; F01D 5/02; F01D 5/225;
(Continued)

(56) References Cited

U.S. PATENT DOCUMENTS 3,658,439 A 4/1972 Kydd
3,736,071 A 5/1973 Kydd
(Continued)

FOREIGN PATENT DOCUMENTS

EP 0670953 B1 5/1998
EP 0864728 A2 9/1998
(Continued)

OTHER PUBLICATIONS

Extended European Search Report and Opinion issued in connection with corresponding EP Application No. 16195004.3 dated Mar. 3, 2017.
(Continued)

*Primary Examiner* — Logan Kraft
*Assistant Examiner* — Danielle M Christensen
(74) *Attorney, Agent, or Firm* — Ernest G. Cusick; Hoffman Warnick LLC

(57) ABSTRACT

A turbine bucket according to embodiments includes: a base; a blade coupled to the base, extending radially outward from the base, and including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

18 Claims, 7 Drawing Sheets

(51) Int. Cl.

| | |
|---|---|
| ***F01D 5/22*** | (2006.01) |
| ***F01D 9/02*** | (2006.01) |
| ***F01D 17/10*** | (2006.01) |
| *F01D 11/08* | (2006.01) |

(52) U.S. Cl.
CPC ..... *F01D 9/02* (2013.01); *F01D 17/105* (2013.01); *F01D 11/08* (2013.01); *F05D 2220/32* (2013.01); *F05D 2260/20* (2013.01)

(58) Field of Classification Search
CPC . F01D 5/20; F01D 17/105; F01D 9/02; F01D 11/08; F05D 2240/81; F05D 2260/20; F05D 2220/32
USPC ..... 416/95, 97 R
See application file for complete search history.

(56) References Cited

U.S. PATENT DOCUMENTS

| | | | | |
|---|---|---|---|---|
| 3,804,551 | A | 4/1974 | Moore | |
| 3,844,679 | A | 10/1974 | Grondahl et al. | |
| 4,350,473 | A | 9/1982 | Dakin | |
| 4,474,532 | A | 10/1984 | Pazder | |
| 5,403,159 | A | 4/1995 | Green et al. | |
| 5,460,486 | A | 10/1995 | Evans et al. | |
| 5,464,479 | A | 11/1995 | Kenton et al. | |
| 5,488,825 | A | 2/1996 | Davis et al. | |
| 5,829,245 | A | 11/1998 | McQuiggan et al. | |
| 5,857,837 | A | 1/1999 | Zelesky et al. | |
| 5,902,093 | A | 5/1999 | Liotta et al. | |
| 6,164,914 | A * | 12/2000 | Correia | F01D 5/186 415/115 |
| 6,499,950 | B2 | 12/2002 | Willett et al. | |
| 6,761,534 | B1 | 7/2004 | Willett | |
| 6,824,359 | B2 | 11/2004 | Chlus et al. | |
| 6,902,372 | B2 | 6/2005 | Liang | |
| 6,974,308 | B2 | 12/2005 | Halfmann et al. | |
| 7,104,757 | B2 | 9/2006 | Gross | |
| 7,303,376 | B2 | 12/2007 | Liang | |
| 7,481,623 | B1 | 1/2009 | Liang | |
| 7,537,431 | B1 | 5/2009 | Liang | |
| 7,563,072 | B1 | 7/2009 | Liang | |
| 7,645,122 | B1 | 1/2010 | Liang | |
| 7,686,581 | B2 | 3/2010 | Brittingham et al. | |
| 7,753,650 | B1 | 7/2010 | Liang | |
| 7,766,617 | B1 | 8/2010 | Liang | |
| 7,780,414 | B1 | 8/2010 | Liang | |
| 7,857,589 | B1 | 12/2010 | Liang | |
| 7,862,299 | B1 | 1/2011 | Liang | |
| 7,901,181 | B1 | 3/2011 | Liang | |
| 7,901,183 | B1 | 3/2011 | Liang | |
| 8,011,888 | B1 | 9/2011 | Liang | |
| 8,047,788 | B1 | 11/2011 | Liang | |
| 8,052,378 | B2 | 11/2011 | Draper | |
| 8,052,395 | B2 | 11/2011 | Tragesser et al. | |
| 8,070,436 | B2 | 12/2011 | Mitchell | |
| 8,100,654 | B1 | 1/2012 | Liang | |
| 8,113,780 | B2 | 2/2012 | Cherolis et al. | |
| 8,118,553 | B2 | 2/2012 | Liang | |
| 8,177,507 | B2 | 5/2012 | Pietraszkiewicz et al. | |
| 8,297,927 | B1 | 10/2012 | Liang | |
| 8,348,612 | B2 | 1/2013 | Brittingham | |
| 8,360,726 | B1 | 1/2013 | Liang | |
| 8,444,372 | B2 | 5/2013 | Suthar et al. | |
| 8,500,401 | B1 | 8/2013 | Liang | |
| 8,628,298 | B1 | 1/2014 | Liang | |
| 8,702,375 | B1 | 4/2014 | Liang | |
| 8,801,377 | B1 | 8/2014 | Liang | |
| 8,920,123 | B2 | 12/2014 | Lee | |
| 9,206,695 | B2 | 12/2015 | Pointon et al. | |
| 9,228,439 | B2 | 1/2016 | Pointon et al. | |
| 9,314,838 | B2 | 4/2016 | Pointon et al. | |
| 9,518,469 | B2 | 12/2016 | Tibbott et al. | |
| 2001/0012484 | A1 | 8/2001 | Beeck et al. | |
| 2002/0150474 | A1 | 10/2002 | Balkcum, III et al. | |
| 2002/0197159 | A1 | 12/2002 | Roeloffs | |
| 2002/0197160 | A1 | 12/2002 | Liang | |
| 2003/0059304 | A1 | 3/2003 | Leeke et al. | |
| 2003/0118445 | A1 | 6/2003 | Lee et al. | |
| 2003/0133795 | A1 | 7/2003 | Manning et al. | |
| 2003/0147750 | A1 | 8/2003 | Slinger et al. | |
| 2004/0126236 | A1 | 7/2004 | Lee et al. | |
| 2004/0146401 | A1 | 7/2004 | Chlus et al. | |
| 2005/0111979 | A1 | 5/2005 | Liang | |
| 2005/0265837 | A1 | 12/2005 | Liang | |
| 2006/0056969 | A1 * | 3/2006 | Jacala | F01D 5/186 416/97 R |
| 2006/0222494 | A1 | 10/2006 | Liang | |
| 2007/0177976 | A1 | 8/2007 | Cunha et al. | |
| 2007/0189896 | A1 | 8/2007 | Itzel et al. | |
| 2008/0008599 | A1 | 1/2008 | Cunha et al. | |
| 2008/0031738 | A1 | 2/2008 | Lee | |
| 2008/0056908 | A1 | 3/2008 | Morris et al. | |
| 2008/0170946 | A1 * | 7/2008 | Brittingham | F01D 5/187 416/97 R |
| 2008/0286115 | A1 | 11/2008 | Liang | |
| 2009/0196737 | A1 | 8/2009 | Mitchell | |
| 2009/0214328 | A1 | 8/2009 | Tibbott et al. | |
| 2009/0304520 | A1 | 12/2009 | Brittingham et al. | |
| 2010/0040480 | A1 | 2/2010 | Webster et al. | |
| 2011/0123351 | A1 | 5/2011 | Hada et al. | |
| 2012/0082567 | A1 | 4/2012 | Tibbott et al. | |
| 2012/0107134 | A1 | 5/2012 | Harris, Jr. et al. | |
| 2012/0171047 | A1 | 7/2012 | Itzel et al. | |
| 2013/0115059 | A1 | 5/2013 | Walunj et al. | |
| 2013/0323080 | A1 | 12/2013 | Martin et al. | |
| 2014/0093389 | A1 | 4/2014 | Morris et al. | |
| 2014/0093390 | A1 | 4/2014 | Pointon et al. | |
| 2014/0093392 | A1 | 4/2014 | Tibbott et al. | |
| 2016/0017718 | A1 | 1/2016 | Zhang et al. | |

FOREIGN PATENT DOCUMENTS

| | | | |
|---|---|---|---|
| EP | 1116861 | A2 | 7/2001 |
| EP | 1 793 086 | A2 | 6/2007 |
| GB | 2 005 775 | A | 4/1979 |
| JP | S59231102 | A | 12/1984 |
| JP | H01134003 | A | 5/1989 |
| JP | H05156901 | A | 6/1993 |
| JP | H05248204 | A | 9/1993 |
| JP | H1172005 | A | 3/1999 |
| JP | H11223101 | A | 8/1999 |
| JP | 2001073704 | A | 3/2001 |
| JP | 2001193404 | A | 7/2001 |
| JP | 2005054799 | A | 3/2005 |
| JP | 2005069236 | A | 3/2005 |
| JP | 2005337256 | A | 12/2005 |
| JP | 2006037957 | A | 2/2006 |
| JP | 2008169845 | A | 7/2008 |
| JP | 2011-001919 | A | 1/2011 |
| JP | 2012140946 | A | 7/2012 |
| JP | 2013117227 | A | 6/2013 |
| JP | 2013144994 | A | 7/2013 |
| JP | 2013245674 | A | 12/2013 |
| JP | 2016156377 | A | 9/2016 |

OTHER PUBLICATIONS

U.S. Appl. No. 14/923,697, Office Action 1 dated Oct. 6, 2017, (GEEN-0671-US), 32 pages.

* cited by examiner

TURBINE BUCKET HAVING OUTLET PATH IN SHROUD

BACKGROUND OF THE INVENTION

The subject matter disclosed herein relates to turbines. Specifically, the subject matter disclosed herein relates to buckets in gas turbines.

Gas turbines include static blade assemblies that direct flow of a working fluid (e.g., gas) into turbine buckets connected to a rotating rotor. These buckets are designed to withstand the high-temperature, high-pressure environment within the turbine. Some conventional shrouded turbine buckets (e.g., gas turbine buckets), have radial cooling holes which allow for passage of cooling fluid (i.e., high-pressure air flow from the compressor stage) to cool those buckets. However, this cooling fluid is conventionally ejected from the body of the bucket at the radial tip, and can end up contributing to mixing losses in that radial space.

BRIEF DESCRIPTION OF THE INVENTION

Various embodiments of the disclosure include a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

A first aspect of the disclosure includes: a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

A second aspect of the disclosure includes: a turbine bucket having: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; a plurality of radially extending cooling passageways within the body; and at least one bleed aperture fluidly coupled with a first set of the plurality of radially extending cooling passageways, the at least one bleed aperture extending through the body at the trailing edge; and a shroud coupled to the blade radially outboard of the blade, the shroud including an outlet path extending at least partially circumferentially through the shroud and fluidly connected with all of a second, distinct set of the plurality of radially extending cooling passageways within the body.

A third aspect of the disclosure includes: a turbine having: a stator; and a rotor contained within the stator, the rotor having: a spindle; and a plurality of buckets extending radially from the spindle, at least one of the plurality of buckets including: a base; a blade coupled to the base and extending radially outward from the base, the blade including: a body having: a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including: a plurality of radially extending outlet passageways fluidly connected with a first set of the plurality of radially extending cooling passageways within the body; and an outlet path extending at least partially circumferentially through the shroud and fluidly connected with all of a second, distinct set of the plurality of radially extending cooling passageways within the body.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

DETAILED DESCRIPTION OF THE INVENTION

As noted herein, the subject matter disclosed relates to turbines. Specifically, the subject matter disclosed herein relates to cooling fluid flow in gas turbines.

In contrast to conventional approaches, various embodiments of the disclosure include gas turbomachine (or, turbine) buckets having a shroud including an outlet path. The outlet path can be fluidly connected with a plurality of radially extending cooling passageways in the blade, and can direct outlet of cooling fluid from a set (e.g., two or more) of those cooling passageways to a location radially outboard of the shroud, and proximate the trailing edge of the bucket.

As denoted in these Figures, the "A" axis represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. It is further understood that common numbering between FIGURES can denote substantially identical components in the FIGURES.

In order to cool buckets in a gas turbine, cooling flow should have a significant velocity as it travels through the cooling passageways within the airfoil. This velocity can be achieved by supplying the higher pressure air at bucket base/root relative to pressure of fluid/hot gas in the radially outer region of the bucket. Cooling flow exiting at the radially outer region at a high velocity is associated with high kinetic energy. In conventional bucket designs with cooling outlets ejecting this high kinetic energy cooling flow in radially outer region, most of this energy not only goes waste, but also creates additional mixing losses in the radially outer region (while it mixes with tip leakage flow coming from gap between the tip rail and adjacent casing).

Figure 1:
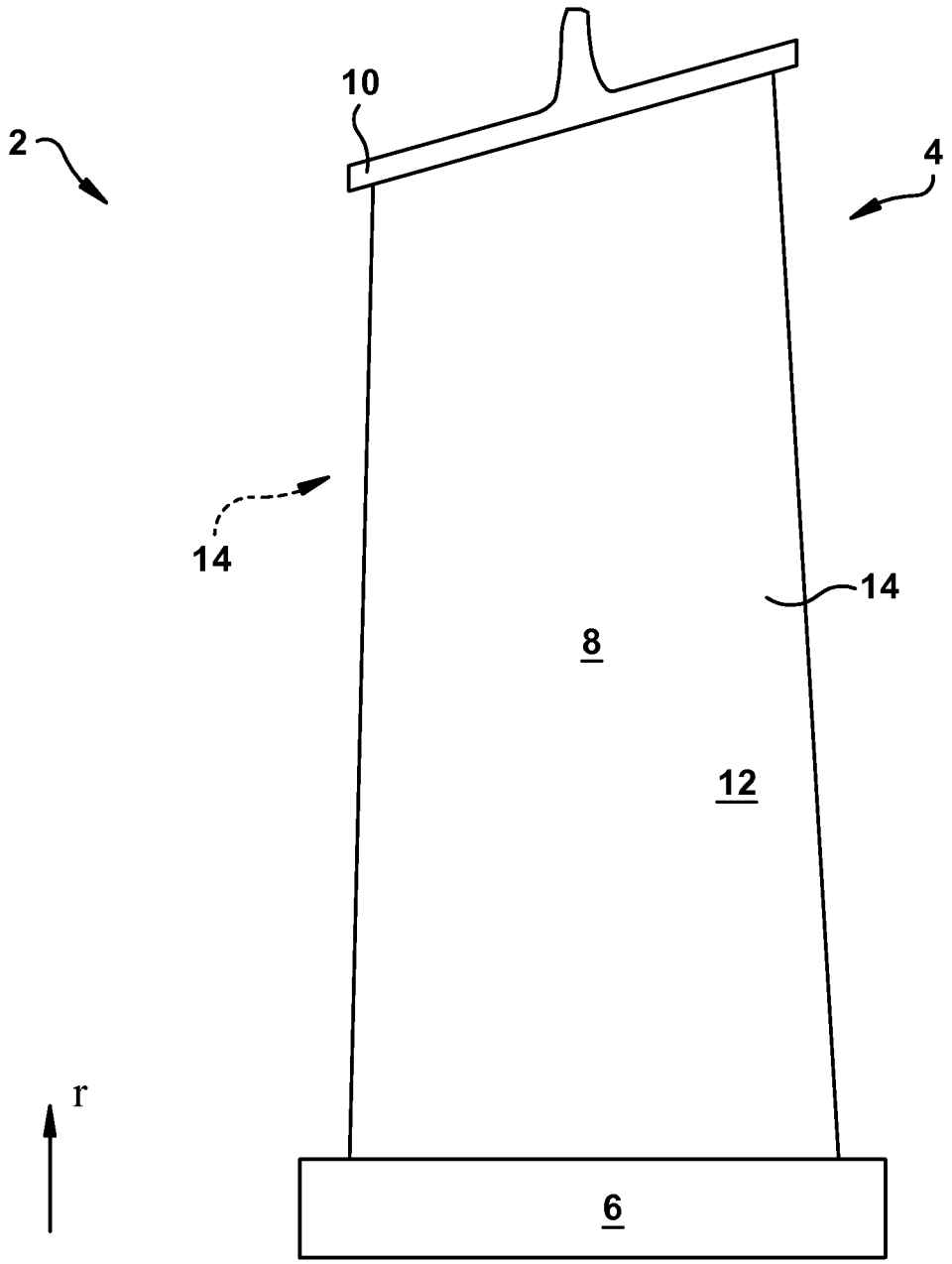
FIG. 1 shows a side schematic view of a turbine bucket according to various embodiments.
Figure 2:
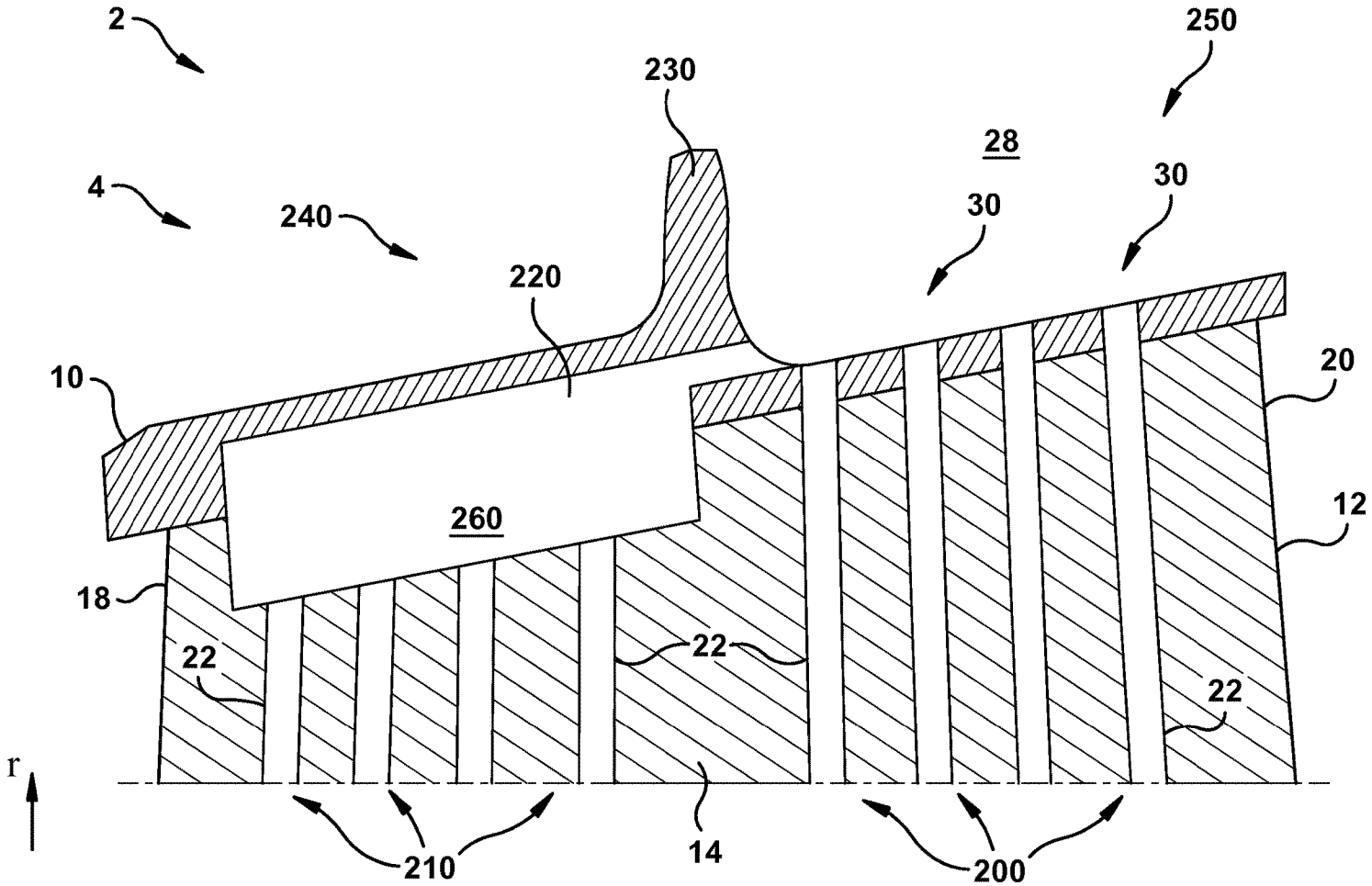
FIG. 2 shows a close-up cross-sectional view of the bucket of FIG. 1 according to various embodiments.

Turning to FIG. 1, a side schematic view of a turbine bucket 2 (e.g., a gas turbine blade) is shown according to various embodiments. FIG. 2 shows a close-up cross-sectional view of bucket 2, with particular focus on the radial tip section 4 shown generally in FIG. 1. Reference is made to FIGS. 1 and 2 simultaneously. As shown, bucket 2 can include a base 6, a blade 8 coupled to base 6 (and extending radially outward from base 6, and a shroud 10 coupled to the blade 8 radially outboard of blade 8. As is known in the art, base 6, blade 8 and shroud 10 may each be formed of one or more metals (e.g., steel, alloys of steel, etc.) and can be formed (e.g., cast, forged or otherwise machined) according to conventional approaches. Base 6, blade 8 and shroud 10 may be integrally formed (e.g., cast, forged, three-dimensionally printed, etc.), or may be formed as separate components which are subsequently joined (e.g., via welding, brazing, bonding or other coupling mechanism).

In particular, FIG. 2 shows blade 8 which includes a body 12, e.g., an outer casing or shell. The body 12 (FIGS. 1-2) has a pressure side 14 and a suction side 16 opposing pressure side 14 (suction side 16 obstructed in FIG. 2). Body 12 also includes a leading edge 18 between pressure side 14 and suction side 16, as well as a trailing edge 20 between pressure side 14 and suction side 16 on a side opposing leading edge 18. As seen in FIG. 2, bucket 2 also includes a plurality of radially extending cooling passageways 22 within body 12. These radially extending cooling passageways 22 can allow cooling fluid (e.g., air) to flow from a radially inner location (e.g., proximate base 6) to a radially outer location (e.g., proximate shroud 10). The radially extending cooling passageways 22 can be fabricated along with body 12, e.g., as channels or conduits during casting, forging, three-dimensional (3D) printing, or other conventional manufacturing technique.

As shown in FIG. 2, in some cases, shroud 10 includes a plurality of outlet passageways 30 extending from body 12 to radially outer region 28. Outlet passageways 30 are each fluidly coupled with a first set 200 of the radially extending cooling passageway 22, such that cooling fluid flowing through corresponding radially extending cooling passageway(s) 22 (in first set 200) exits body 12 through outlet passageways 30 extending through shroud 10. In various embodiments, as shown in FIG. 2, outlet passageways 30 are fluidly isolated from a second set 210 (distinct from first set 200) of radially extending cooling passageways 22. That is, as shown in FIG. 2, in various embodiments, shroud 10 includes and outlet path 220 extending at least partially circumferentially through shroud 10 and fluidly connected with all of second set 210 of radially extending cooling passageways 22 in body 12. Shroud 10 includes outlet path 220 which provides an outlet for a plurality (e.g., 2 or more, forming second set 210) of radially extending cooling passageways 22, and provides a fluid pathway isolated from radially extending cooling passageways 22 in first set 200.

As seen in FIGS. 1 and 2, shroud 10 can include a rail 230 delineating an approximate mid-point between a leading half 240 and a trailing half 250 of shroud 10. In various embodiments, an entirety of cooling fluid passing through second set 210 of radially extending cooling passageways 22 exits body 12 through outlet path 220. In various embodiment, first set 200 of radially extending cooling passageways 22 and outlet path 220 outlet to location 28 radially outboard of shroud 10. In some cases, outlet path 220 is fluidly connected with a pocket 260 within body 12 of blade 8, where pocket 260 provides a fluid passageway between second set 210 of radially extending cooling passageways 22 and outlet path 220 in shroud 10.

Figure 3:
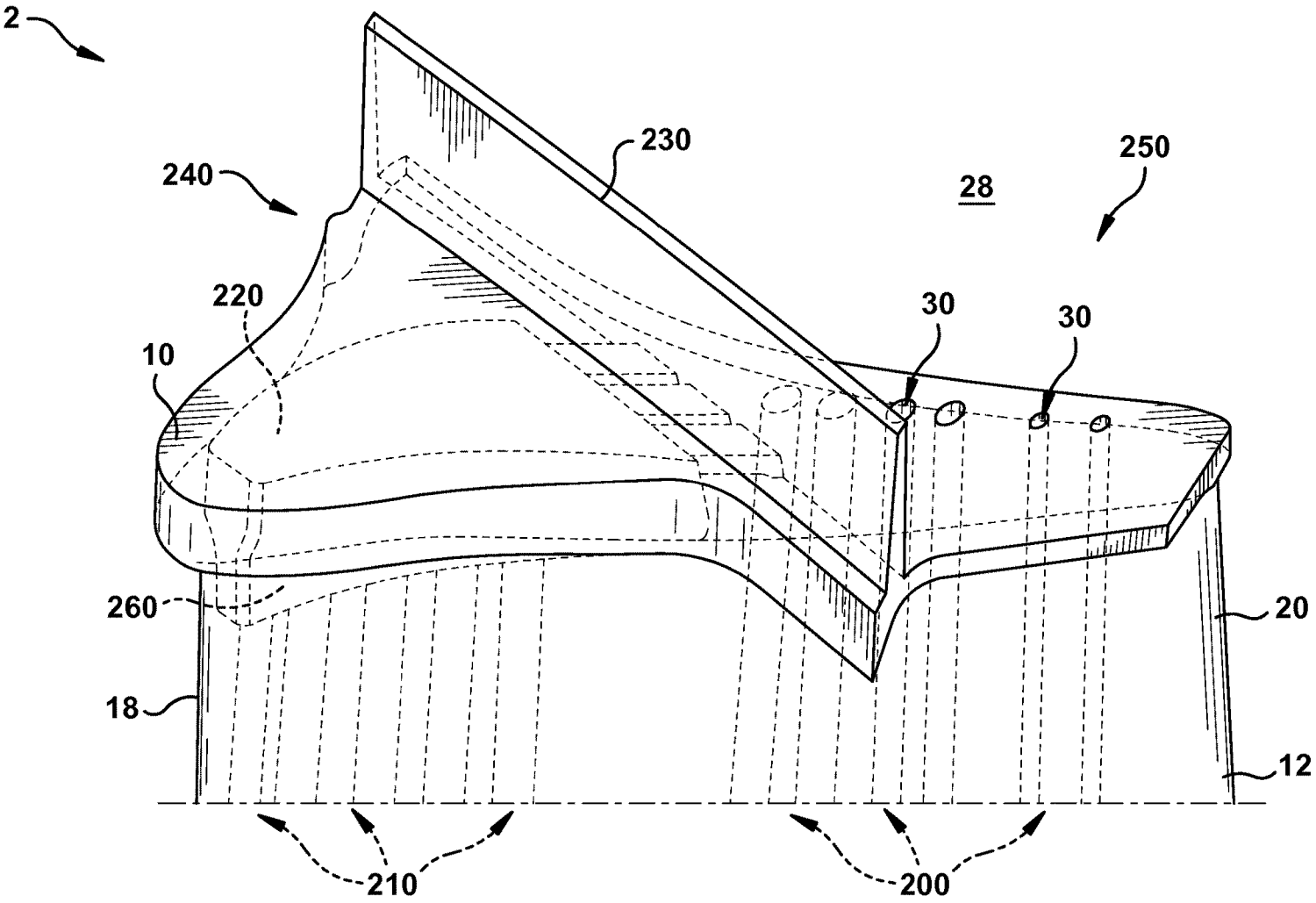
FIG. 3 shows a partially transparent three-dimensional perspective view of the bucket of FIG. 1 and FIG. 2.

FIG. 3 shows a partially transparent three-dimensional perspective view of bucket 2, depicting various features. It is understood, and more clearly illustrated in FIG. 3, that outlet path 220, which is part of shroud 10, is fluidly connected with pocket 260, such that pocket 260 may be considered an extension of outlet path 220, or vice versa. Further, pocket 260 and outlet path 220 may be formed as a single component (e.g., via conventional manufacturing techniques). It is further understood that the portion of shroud 10 at leading half 240 may have a greater thickness (measured radially) than the portion of shroud 10 at trailing half 250, for example, in order to accommodate for outlet path 220.

Figure 4:
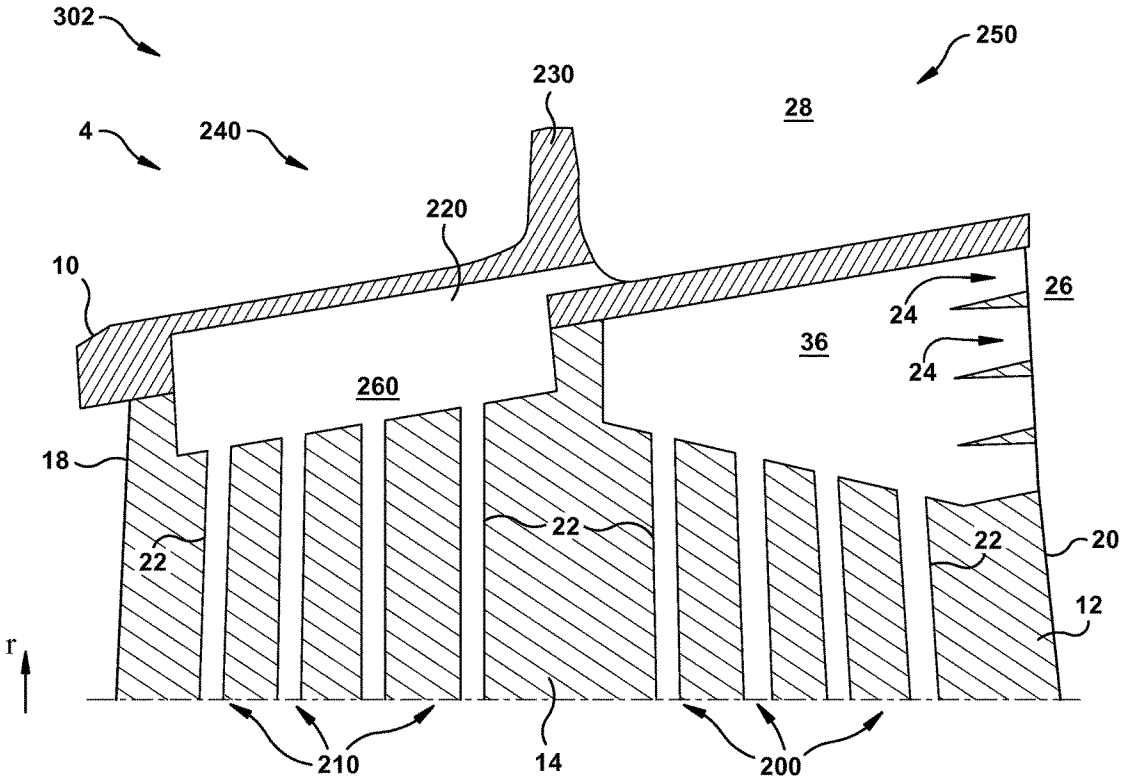
FIG. 4 shows a close-up cross-sectional view of a bucket according to various additional embodiments.

According to various additional embodiments described herein and shown in FIG. 4, a bucket 302 can further include a plenum 36 within body 12, where plenum 36 is fluidly connected with the first set 200 of plurality of radially extending cooling passageways 22 and, at least one bleed aperture(s) 24. Plenum 36 can provide a mixing location for cooling flow from first set 200 of radially extending cooling passageways 22, and may outlet to trailing edge 20 through bleed apertures 24. Plenum 36 can fluidly isolate first set 200 of radially extending cooling passageways 22 from second set 210 of radially extending cooling passageways 22, thus isolating first set 200 from outlet path 220. In some cases, as shown in FIG. 4, plenum 36 can have a trapezoidal cross-sectional shape within body 12 (when cross-section is taken through pressure side face), such that it has a longer side at the trailing edge 20 than at an interior, parallel side. According to various embodiments, plenum 36 extends approximately 3 percent to approximately 30 percent of a length of trailing edge 20. Bleed apertures 24 in bucket 302 (several shown), as noted herein, can extend through body 12 at trailing edge 20, and fluidly couple first set 200 of radially extending cooling passageways 22 with an exterior region 26 proximate trailing edge 20. In additional contrast to conventional buckets, bucket 302 includes bleed apertures 24 which extend through body 12 at trailing edge 20, in a location proximate (e.g., adjacent) shroud 10 (but radially inboard of shroud 10). In various embodiments, bleed apertures 24 extend along approximately 3 percent to approximately 30 percent of trailing edge 20 toward base 6, as measured from the junction of blade 8 and shroud 10 at trailing edge 20.

Figure 5:
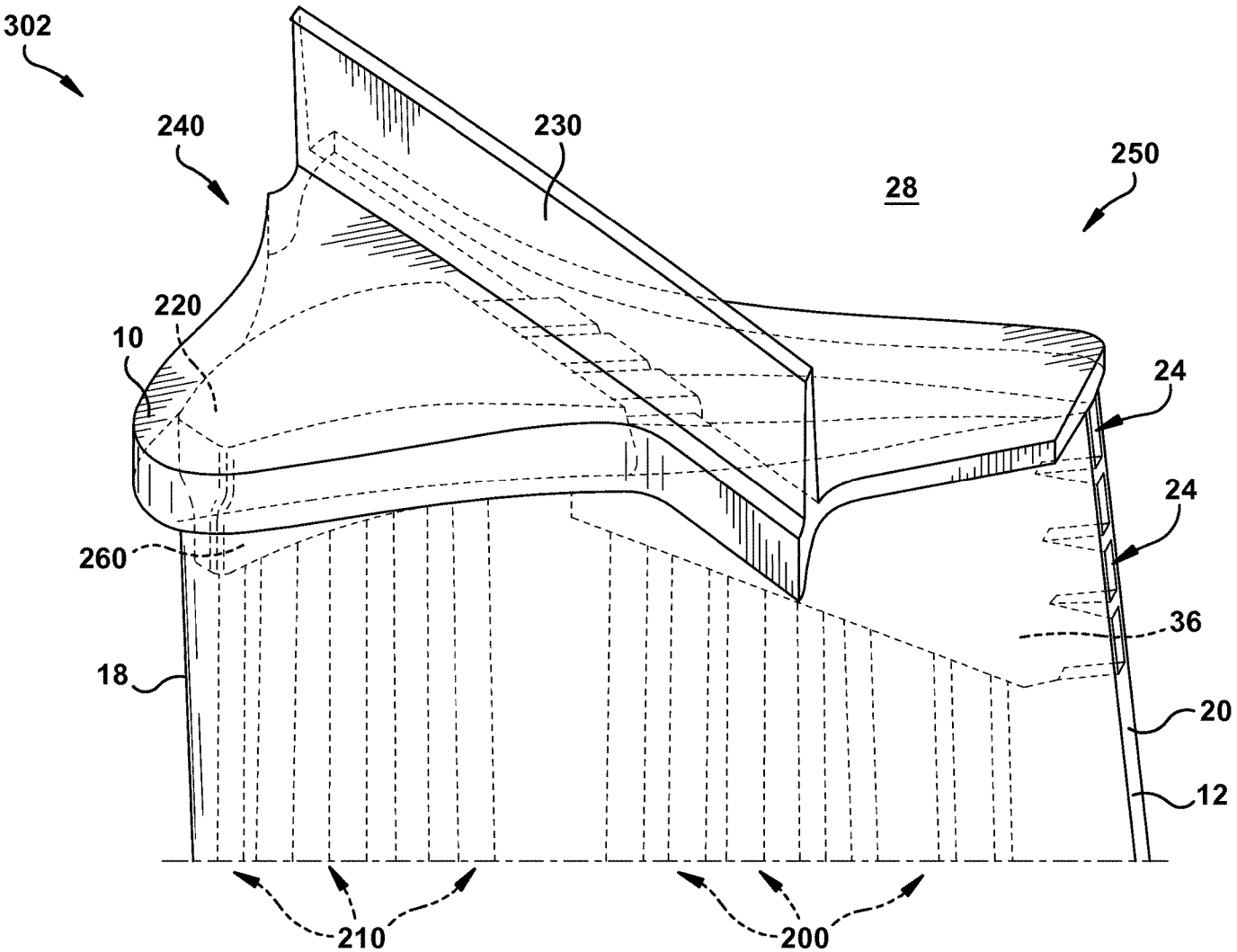
FIG. 5 shows a partially transparent three-dimensional perspective view of the bucket of FIG. 4.

FIG. 5 shows a partially transparent three-dimensional perspective view of bucket 302, depicting various features. It is understood, and more clearly illustrated in FIG. 5, that outlet path 220, which is part of shroud 10, is fluidly connected with pocket 260, such that pocket 260 may be considered an extension of outlet path 220, or vice versa. Further, pocket 260 and outlet path 220 may be formed as a single component (e.g., via conventional manufacturing techniques). It is further understood that the portion of shroud 10 at leading half 240 may have a greater thickness (measured radially) than the portion of shroud 10 at trailing half 250, for example, in order to accommodate for outlet path 220.

Figure 6:
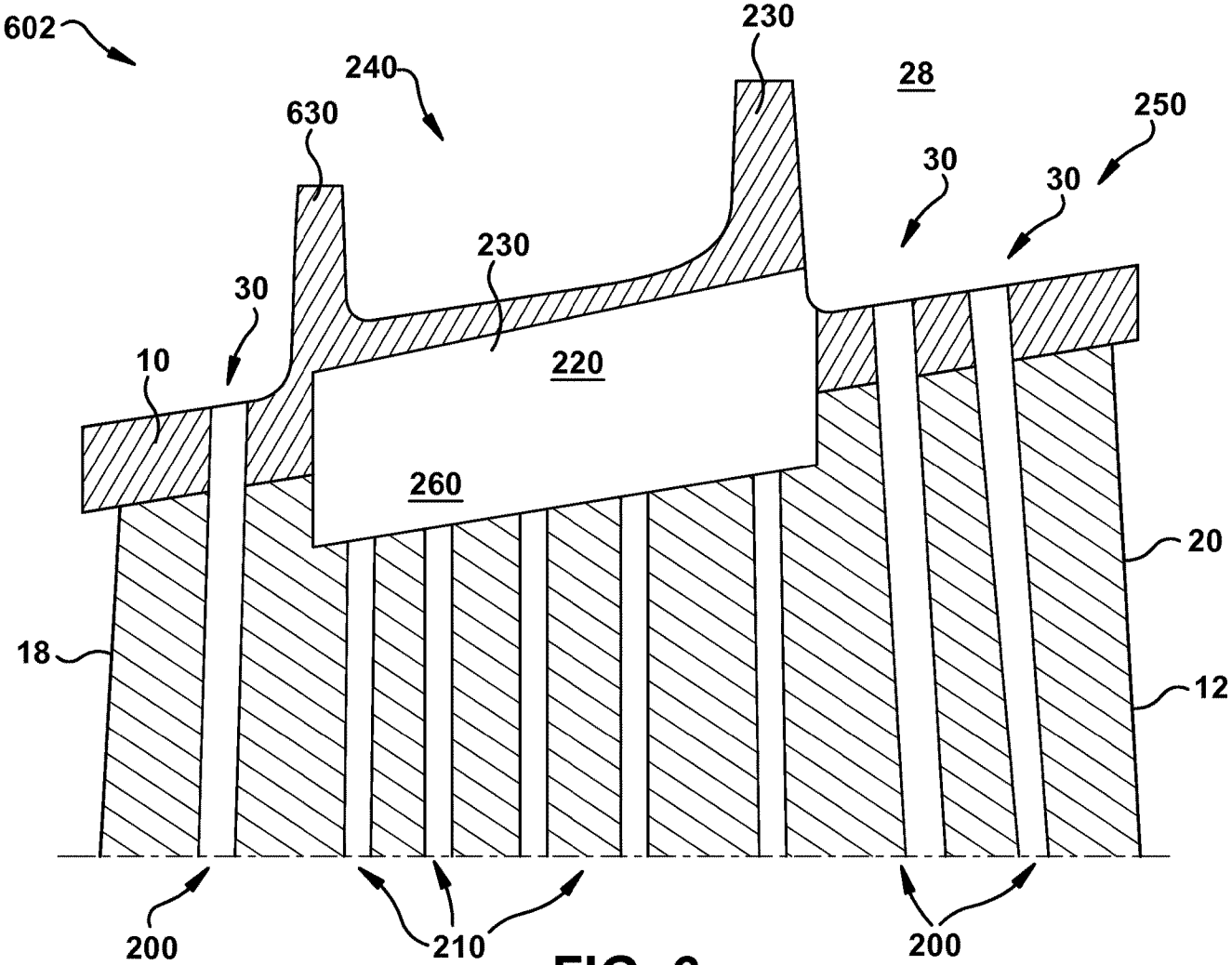
FIG. 6 shows a close-up schematic cross-sectional depiction of an additional bucket according to various embodiments.

FIG. 6 shows a close-up schematic cross-sectional depiction of an additional bucket 602 according to various embodiments. Bucket 602 can include outlet passageways 30 located on both circumferential sides of outlet path 220, that is, outlet path 220 is located between adjacent outlet passageways 30 in shroud 10. In this configuration, shroud 10 can include a second rail 630, located within leading half 240 of shroud. Outlet path 220 can extend from second rail 630 to rail 230, and exit at trailing half 250 of shroud proximate outlet passageways 30 at trailing half 250.

In contrast to conventional buckets, buckets 2, 302, 602 having outlet path 220 allow for high-velocity cooling fluid to be ejected from shroud 10 beyond rail 230 (circumferentially past rail 230, or, downstream of rail 230), aligning with the direction of hot gasses flowing proximate trailing edge 12. Similar to the hot gasses, the reaction force of cooling flow ejecting from shroud 10 (via outlet path 220) can generate a reaction force on bucket 2, 302, 602. This reaction force can increase the overall torque on bucket 2, 302, 602, and increase the mechanical shaft power of a turbine employing bucket 2, 302, 602. In the radially outboard region of shroud 10, static pressure is always lower in trailing half region 250 than leading half region 240. The cooling fluid pressure ratio is defined as a ratio of delivery pressure of cooling fluid at base 6 to the ejection pressure at the hot gas path proximate radially outboard location 28 (referred to as "sink pressure"). While there are specific cooling fluid pressure ratio requirements for buckets in gas turbines, reduction in the sink pressure can reduce the requirement for higher-pressure cooling fluid at the inlet proximate base 6. Bucket 2, 302, 602, including outlet path 220 can reduce sink pressure when compared with conventional buckets, thus requiring a lower supply pressure from the compressor to maintain a same pressure ratio. This reduces the work required by the compressor (to compress cooling fluid), and improves efficiency in a gas turbine employing bucket 2, 302, 602 relative to conventional buckets. Even further, buckets 2, 302, 602 can aid in reducing mixing losses in a turbine employing such buckets. For example mixing losses in radially outer region 28 that are associated with mixing of cooling flow and tip leakage flow that exist in conventional configurations are greatly reduced by the directional flow of cooling fluid exiting outlet path 220. Further, cooling fluid exiting outlet path 220 is aligned with the direction of hot gas flow, reducing mixing losses between cold/hot fluid flow. Outlet path 220 can further aid in reducing mixing of cooling fluid with leading edge hot gas flows (when compared with conventional buckets), where rail 230 acts as a curtain-like mechanism. Outlet path 220 can circulate the cooling fluid through the tip shroud 10, thereby reducing neighboring metal temperatures when compared with conventional buckets. With the continuous drive to increase firing temperatures in gas turbines, buckets 2, 302, 602 can enhance cooling in turbines employing such buckets, allowing for increased firing temperatures and greater turbine output.

Figure 7:
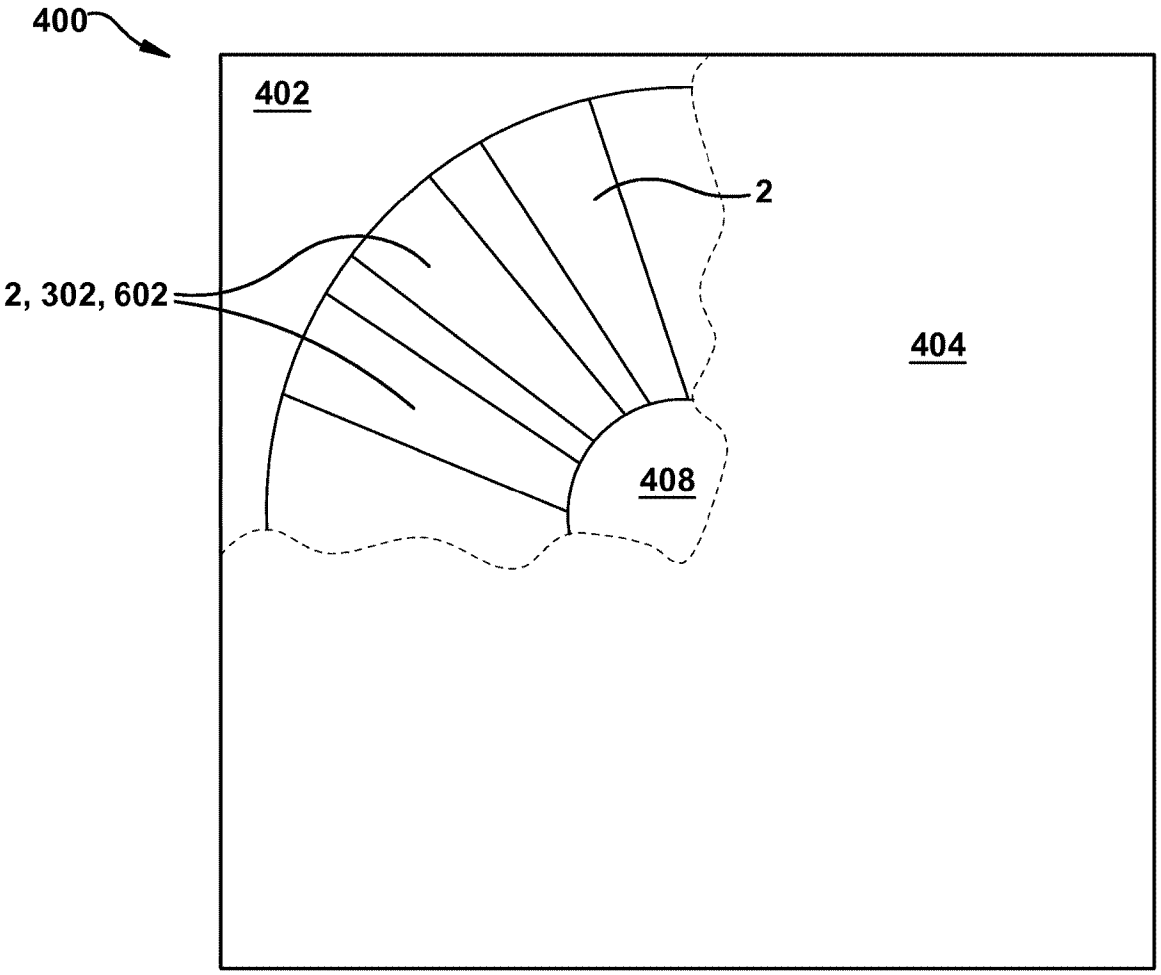
FIG. 7 shows a schematic partial cross-sectional depiction of a turbine according to various embodiments It is noted that the drawings of the invention are not necessarily to scale. The drawings are intended to depict only typical aspects of the invention, and therefore should not be considered as limiting the scope of the invention. In the drawings, like numbering represents like elements between the drawings.

FIG. 7 shows a schematic partial cross-sectional depiction of a turbine 400, e.g., a gas turbine, according to various embodiments. Turbine 400 includes a stator 402 (shown within casing 404) and a rotor 406 within stator 402, as is known in the art. Rotor 406 can include a spindle 408, along with a plurality of buckets (e.g., buckets 2, 302 and/or 602) extending radially from spindle 408. It is understood that buckets (e.g., buckets 2, 302 and/or 602) within each stage of turbine 400 can be substantially a same type of bucket (e.g., bucket 2). In some cases, buckets (e.g., buckets 2, 302 and/or 602) can be located in a mid-stage within turbine 400. That is, where turbine 400 includes four (4) stages (axially dispersed along spindle 408, as is known in the art), buckets (e.g., buckets 2, 302 and/or 602) can be located in a second stage (stage 2), third stage (stage 3) or fourth stage (stage 4) within turbine 400, or, where turbine 400 includes five (5) stages (axially dispersed along spindle 408), buckets (e.g., buckets 2, 302 and/or 602) can be located in a third stage (stage 3) within turbine 400.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including:

a plurality of radially extending outlet passageways fluidly connected with a first set of the plurality of radially extending cooling passageways within the body;

an outlet path extending at least partially circumferentially through the shroud and fluidly connected with all of a second, distinct set of the plurality of radially extending cooling passageways within the body; and a rail delineating an approximate mid-point between a leading half of the shroud and a trailing half of the shroud, wherein the outlet path extends within the shroud through the leading half and the rail.

2. The turbine bucket of claim 1, further comprising:

at least one bleed aperture fluidly coupled with at least one of the first set of the plurality of radially extending cooling passageways, the at least one bleed aperture extending through the body at the trailing edge.

3. The turbine bucket of claim 2, further comprising a plenum within the body, the plenum fluidly connected with first set of the plurality of radially extending cooling passageways and the at least one bleed aperture.

4. The turbine bucket of claim 3, wherein the plenum fluidly isolates the first set of the plurality of radially extending cooling passageways from the outlet path.

5. The turbine bucket of claim 4, wherein the plenum has a trapezoidal cross-sectional shape within the body, as seen in a cross-sectional plane intersecting the leading edge and the trailing edge.

6. The turbine bucket of claim 1, wherein the plurality of radially extending outlet passageways extend from the body to a radially outer region.

7. The turbine bucket of claim 6, wherein the plurality of radially extending outlet passageways are fluidly isolated from the outlet path in the shroud.

8. The turbine bucket of claim 7, wherein the plurality of radially extending outlet passageways are located proximate the trailing edge of the body.

9. The turbine bucket of claim 1, wherein an entirety of a cooling fluid passing through the second, distinct set of the plurality of radially extending cooling passageways within the body exits the body through the outlet path.

10. The turbine bucket of claim 9, wherein the plurality of radially extending outlet passageways fluidly outlet to a location radially outboard of the shroud, and wherein the outlet path outlets to the location radially outboard of the shroud.

11. A turbine bucket comprising:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge;

a plurality of radially extending cooling passageways within the body; and at least one bleed aperture fluidly coupled with a first set of the plurality of radially extending cooling passageways, the at least one bleed aperture extending through the body at the trailing edge; and a shroud coupled to the blade radially outboard of the blade, the shroud including:

an outlet path extending at least partially circumferentially through the shroud and fluidly connected with all of a second, distinct set of the plurality of radially extending cooling passageways within the body; and a rail delineating an approximate mid-point between a leading half of the shroud and a trailing half of the shroud, wherein the outlet path extends within the shroud through the leading half and the rail.

12. The turbine bucket of claim 11, further comprising a plenum within the body, the plenum fluidly connected with first set of the plurality of radially extending cooling passageways and the at least one bleed aperture.

13. The turbine bucket of claim 12, wherein the plenum fluidly isolates the first set of the plurality of radially extending cooling passageways from the outlet path.

14. The turbine bucket of claim 13, wherein the plenum has a trapezoidal cross-sectional shape within the body, as seen in a cross-sectional plane intersecting the leading edge and the trailing edge.

15. The turbine bucket of claim 11, wherein an entirety of a cooling fluid passing through the second, distinct set of the plurality of radially extending cooling passageways within the body exits the body through the outlet path.

16. The turbine bucket of claim 11, wherein the outlet path outlets to a location radially outboard of the shroud, wherein the at least one bleed aperture outlets to a location radially inboard of the shroud at the trailing edge.

17. A turbine comprising:

a stator; and a rotor contained within the stator, the rotor having:

a spindle; and a plurality of buckets extending radially from the spindle, at least one of the plurality of buckets including:

a base;

a blade coupled to the base and extending radially outward from the base, the blade including:

a body having:

a pressure side; a suction side opposing the pressure side; a leading edge between the pressure side and the suction side; and a trailing edge between the pressure side and the suction side on a side opposing the leading edge; and a plurality of radially extending cooling passageways within the body; and a shroud coupled to the blade radially outboard of the blade, the shroud including:

a plurality of radially extending outlet passageways fluidly connected with a first set of the plurality of radially extending cooling passageways within the body;

an outlet path extending at least partially circumferentially through the shroud and fluidly connected with all of a second, distinct set of the plurality of radially extending cooling passageways within the body; and a rail delineating an approximate mid-point between a leading half of the shroud and a trailing half of the shroud, wherein the outlet path extends within the shroud through the leading half and the rail.

18. The turbine of claim 17, further comprising:

at least one bleed aperture fluidly coupled with at least one of the first set of the plurality of radially extending cooling passageways, the at least one bleed aperture extending through the body at the trailing edge; and a plenum within the body, the plenum fluidly connected with first set of the plurality of radially extending cooling passageways and the at least one bleed aperture.

* * * * *